US005899501A

United States Patent [19]

Maxwell

[11] Patent Number: 5,899,501

[45] Date of Patent: May 4, 1999

[54] KEY HOLDING SYSTEM

[76] Inventor: James C. Maxwell, 338 N. Howard St. Apt. #7, Glendale, Calif. 91206-3789

[21] Appl. No.: 08/871,250

[22] Filed: Jun. 9, 1997

[51] Int. Cl.[6] ..... B42D 3/00

[52] U.S. Cl. ..... 281/31; 281/30; 281/37; 402/4; 70/456; 70/457; 70/458; 70/456 B; 70/459; 70/466

[58] Field of Search ..... 402/4; 281/31, 281/37; 70/456, 457, 458, 456 B, 459, 466

[56] References Cited

U.S. PATENT DOCUMENTS 2,978,897 4/1961 Capitani ..... 70/456 B
4,306,737 12/1981 Errichiello ..... 281/30

*Primary Examiner*—Willmon Fridie, Jr.
*Assistant Examiner*—Mark T. Henderson

[57] ABSTRACT

A key holding system including a binder. A pair of retention brackets are each secured on opposing cover members of the binder. The brackets are longitudinally disposed inwardly of free edges of the cover members. Each bracket defines a plurality of holding spaces. A plurality of tags are dimensioned for positioning in the plurality of holding spaces. The tags are used to hold keys.

3 Claims, 2 Drawing Sheets

FIG. 3
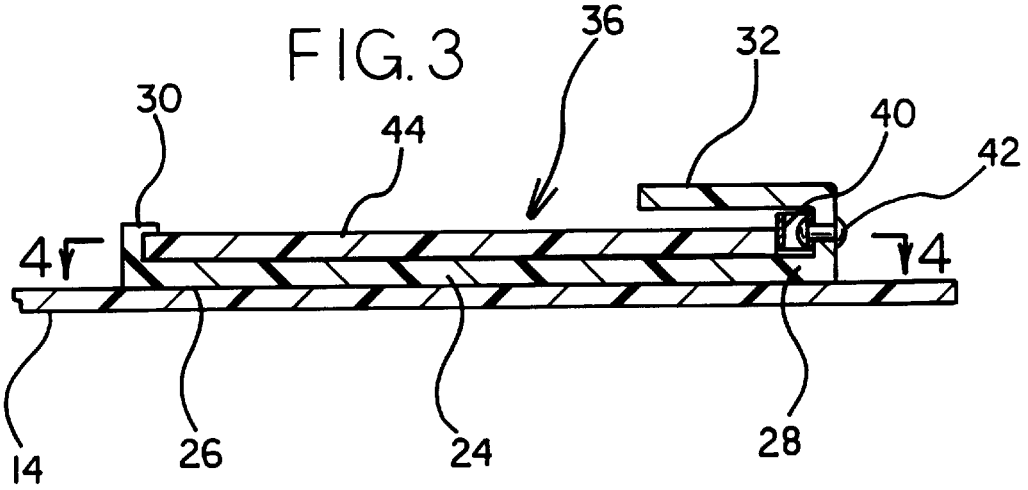
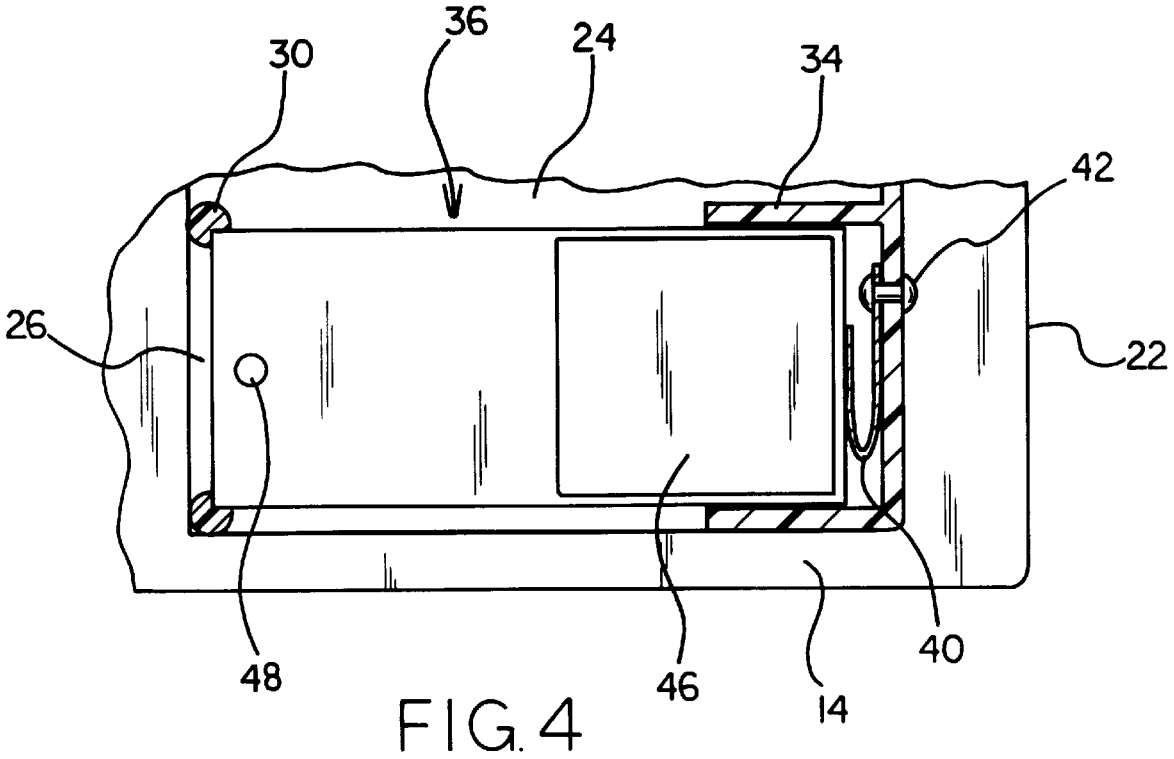
FIG. 4

KEY HOLDING SYSTEM

BACKGROUND OF THE INVENTION

1. Field of the Invention

The present invention relates to a key holding system and more particularly pertains to organizing keys within a notebook for easy transportation with a key holding system.

2. Description of the Prior Art

The use of key holders is known in the prior art. More specifically, key holders heretofore devised and utilized for the purpose of holding keys are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,072,033 to Eckerdt discloses a key holder. U.S. Pat. No. 4,799,587 to Desanto discloses a storage case for keys with plural velcro retainers. U.S. Pat. No. Des. 354,768 to Muller et al. discloses the ornamental design for a ring binder. U.S. Pat. No. 5,291,768 to Rieffel et al. discloses a plastic key tag with a key bar. U.S. Pat. No. 4,939,917 to Cartwright discloses a key control of important security keys. U.S. Pat. No. 4,860,563 to Gerch discloses a keyholder for luggage.

While these devices fulfill their respective, particular objective and requirements, the aforementioned patents do not describe a key holding system for organizing keys within a notebook for easy transportation.

In this respect, the key holding system according to the present invention substantially departs from the conventional concepts and designs of the prior art, and in doing so provides an apparatus primarily developed for the purpose of organizing keys within a notebook for easy transportation.

Therefore, it can be appreciated that there exists a continuing need for new and improved key holding system which can be used for organizing keys within a notebook for easy transportation. In this regard, the present invention substantially fulfills this need.

SUMMARY OF THE INVENTION

In the view of the foregoing disadvantages inherent in the known types of key holders now present in the prior art, the present invention provides an improved key holding system. As such, the general purpose of the present invention, which will be described subsequently in greater detail, is to provide a new and improved key holding system and method which has all the advantages of the prior art and none of the disadvantages.

To attain this, the present invention essentially comprises a binder comprising two cover member and a spine positioned therebetween. The spine has three openable rings disposed thereon for receiving information material. A pair of retention brackets are each secured to the two cover members of the binder. The brackets are longitudinally disposed inwardly of free edges of the cover members. Each bracket is defined by a planar base secured to the cover member. The planar base has an inner end and an outer end. The inner end has a plurality of spaced slotted posts extending upwardly therefrom. The outer end has a cover member extending a length thereof. The cover member is defined by a plurality of side walls spaced therealong corresponding with the slotted posts whereby space extending between two slotted posts and two side walls defines a holding space. A retention spring is disposed within each holding space disposed between the cover member and the planar base. A plurality of tags are provided each having a generally rectangular configuration. Each tag is dimensioned for positioning in one of the holding spaces. Each tag has a clear window portion and an aperture therethrough. A circular key ring is coupled with the aperture.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved key holding system which has all the advantages of the prior art key holders and none of the disadvantages.

It is another object of the present invention to provide a new and improved key holding system which may be easily and efficiently manufactured and marketed.

It is a further object of the present invention to provide a new and improved key holding system which is of durable and reliable construction.

An even further object of the present invention is to provide a new and improved key holding system which is susceptible of a low cost of manufacture with regard to both materials and labor, and which accordingly is then susceptible of low prices of sale to the consuming public, thereby making such a key holding system economically available to the buying public.

Even still another object of the present invention is to provide a new and improved key holding system for organizing keys within a notebook for easy transportation.

Lastly, it is an object of the present invention to provide a new and improved key holding system including a binder. A pair of retention brackets are each secured on opposing cover members of the binder. The brackets are longitudinally disposed inwardly of free edges of the cover members. Each bracket defines a plurality of holding spaces. A plurality of tags are dimensioned for positioning in the plurality of holding spaces. The tags are used to hold keys.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side view of the retention bracket as coupled with one of the tags of the present invention.

FIG. 4 is a cross-sectional view as taken along line 4—4 of FIG. 3.

The same reference numerals refer to the same parts through the various figures.

DESCRIPTION OF THE PREFERRED EMBODIMENT

Figure 1:
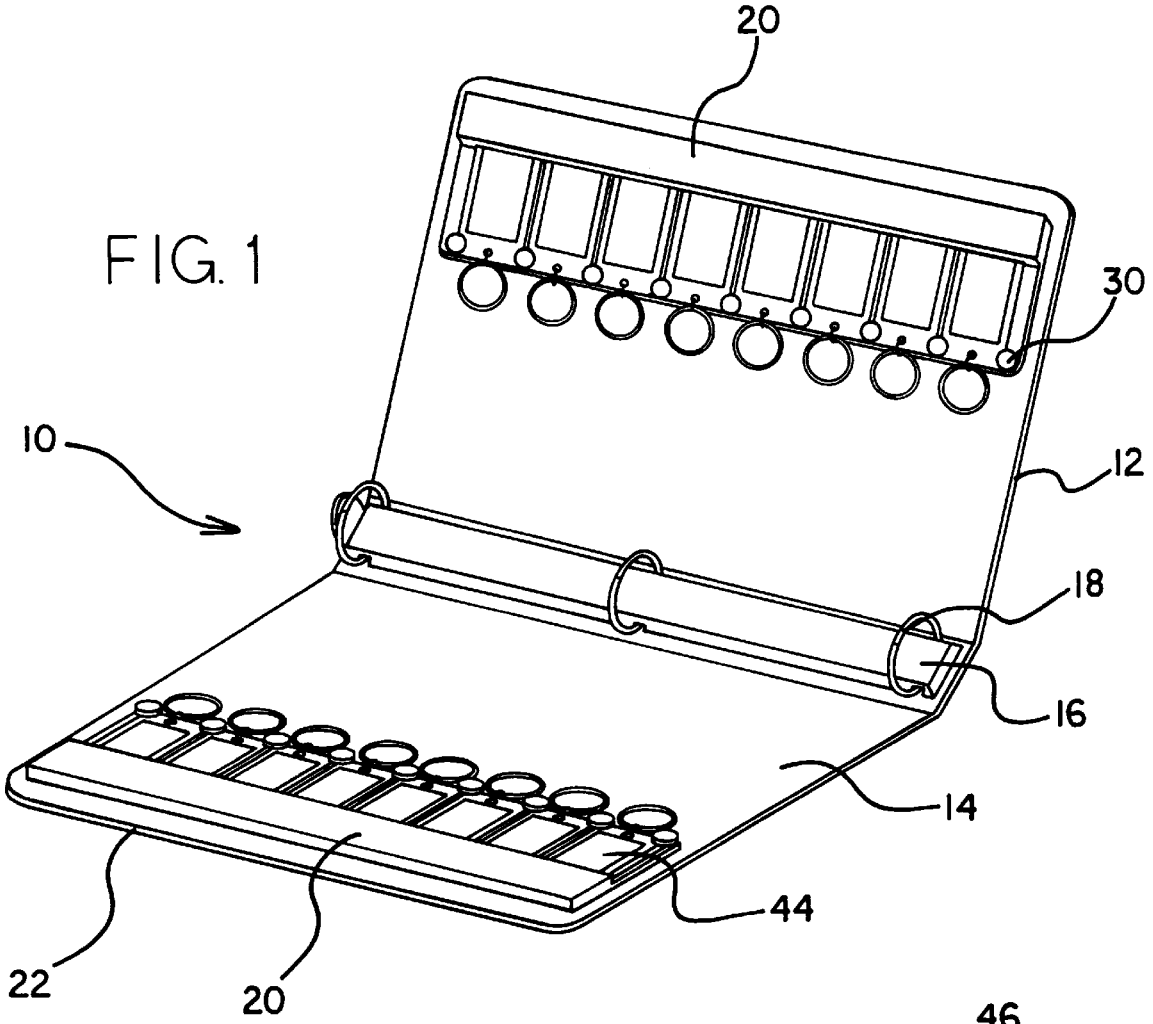
FIG. 1 is a perspective view of the preferred embodiment of the key holding system constructed in accordance with the principles of the present invention.

With reference now to the drawings, and in particular, to FIGS. 1 through 4 thereof, the preferred embodiment of the new and improved key holding system embodying the principles and concepts of the present invention and generally designated by the reference number 10 will be described.

Specifically, it will be noted in the various Figures that the device relates to a key holding system for organizing keys within a notebook for easy transportation. In its broadest context, the device consists of a binder, a pair of retention brackets and a plurality of tags. Such components are individually configured and correlated with respect to each other so as to attain the desired objective.

The binder 12 comprises two cover members 14 and a spine 16 positioned therebetween. The spine 16 has three openable rings 18 disposed thereon for receiving information material. The system 10 can be provided with sheets to be placed within the binder 12 to identify the keys and provide information related to what each key is for.

The pair of retention brackets 20 are each secured to the two cover members 14 of the binder 12. The brackets 20 are longitudinally disposed inwardly of free edges 22 of the cover members 14. Note FIG. 1. Each bracket 20 is defined by a planar base 24 secured to the cover member 14. Note FIG. 3. The planar base 24 has an inner end 26 and an outer end 28. The inner end 26 has a plurality of spaced slotted posts 30 extending upwardly therefrom. Each of the slotted posts 30 has a notch formed therein for purposes to be described hereafter. The outer end 28 has a cover member 32 extending a length thereof. The cover member 32 is defined by a plurality of side walls 34 spaced therealong corresponding with the slotted posts 30 whereby space extending between two slotted posts 30 and two side walls 34 defines a holding space 36. Note FIG. 4. A retention spring 40 is disposed within each holding space 36 disposed between the cover member 32 and the planar base 24. The retention spring 40 is preferably a leaf spring secured to the bracket 20 by a rivet 42. Note FIGS. 3 and 4.

Figure 2:
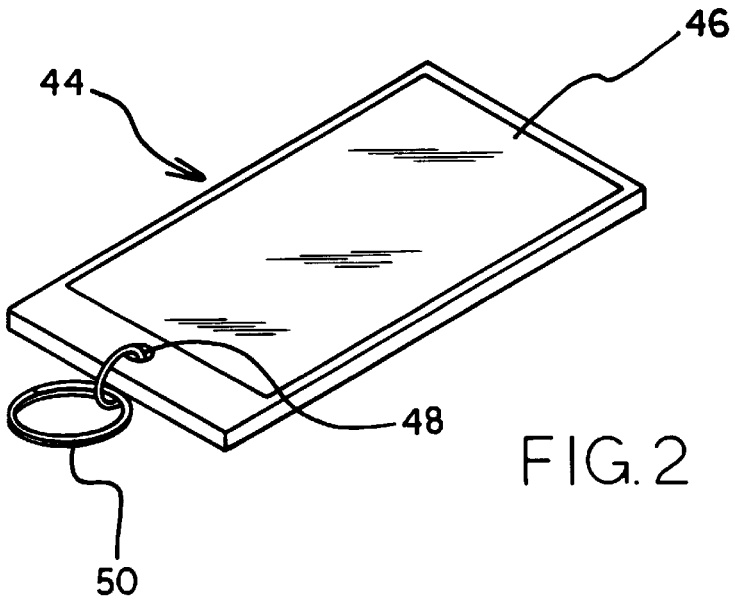
FIG. 2 is a perspective view of one of the tags of the present invention.

The plurality of tags 44 each have a generally rectangular configuration. Note FIGS. 2 and 4. Each tag 44 is dimensioned for positioning in one of the holding spaces 36. Each tag 44 has a clear window portion 46 and an aperture 48 therethrough. The size of the clear window portion 46 can vary according to uses. FIG. 4 illustrates a full size window while FIG. 2 illustrates a half-size window. The windows are used to contain inserted tags identifying a particular key associated therewith. A circular key ring 50 is coupled with the aperture 48. A front edge of a single tag 44 is pushed inwardly of the holding space, thus compressing the spring 40. As the tag 44 is pressed down flush against the planar base 24, the spring 40 will retract, thus pushing a rear edge of the tag 44 within the notches formed within the slotted posts 30 to engage the tag 44 within the system 10. Simply revering the process will allow the tag 44 to be removed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A key holding system for organizing keys within a notebook for easy transportation comprising, in combination:

a binder comprising two cover member and a spine positioned therebetween, the spine having three openable rings disposed thereon for receiving information material;

a pair of retention brackets each secured to the two cover members of the binder, the brackets being longitudinally disposed inwardly of free edges of the cover members, each bracket being defined by a planar base secured to the cover member, the planar base having an inner end and an outer end, the inner end having a plurality of spaced slotted posts extending upwardly therefrom, the outer end having a cover member extending a length thereof, the cover member being defined by a plurality of side walls spaced therealong corresponding with the slotted posts whereby space extending between two slotted posts and two side walls defines a holding space, a retention spring disposed within each holding space disposed between the cover member and the planar base; and a plurality of tags each having a generally rectangular configuration, each tag being dimensioned for positioning in one of the holding spaces, each tag having a clear window portion and an aperture therethrough, a circular key ring coupled with the aperture.

2. A key holding system comprising:

a binder;

a pair of retention brackets each secured on opposing cover members of the binder, the brackets being longitudinally disposed inwardly of free edges of the cover members, each bracket defining a plurality of holding spaces, each bracket is defined by a planar base secured to the cover member, the planar base having an inner end and an outer end, the inner end having a plurality of spaced slotted posts extending upwardly therefrom, the outer end having a cover member extending a length thereof, the cover member being defined by a plurality of side walls spaced therealong corresponding with the slotted posts whereby space between two slotted posts and two side walls defines one of the plurality of holding spaces; and a plurality of tags dimensioned for positioning in the plurality of holding spaces.

3. The key holding system as set forth in claim 2 and further including a retention spring disposed within each holding space disposed between the cover member and the planar base.

* * * * *